US007322370B2

(12) United States Patent
Aulbers et al.

(10) Patent No.: US 7,322,370 B2
(45) **Date of Patent: *Jan. 29, 2008**

(54) DEVICE FOR MONITORING A WASH PROCESS

(75) Inventors: Antonius Paulus Aulbers, Eindhoven (NL); Leonard Marcus Flendrig, Vlaardingen (NL); Evert Nieuwkoop, Delft (NL); Hank Robert Reinhoudt, Vlaardingen (NL); Alexandru Volanschi, Vlaardingen (NL); Johannes Jeichienus Van Der Werff, Eindhoven (NL)

(73) Assignee: JohnsonDiversey, Inc., Sturtevant, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/536,883

(22) Filed: Sep. 29, 2006

(65) Prior Publication Data

US 2007/0023071 A1 Feb. 1, 2007

Related U.S. Application Data

(62) Division of application No. 10/013,799, filed on Dec. 11, 2001, now Pat. No. 7,150,284.

(30) Foreign Application Priority Data

Dec. 15, 2000 (EP) ..... 00204536

(51) Int. Cl.
*B08B 3/02* (2006.01)

(52) U.S. Cl. ..... 134/56 R; 134/113; 134/57 R; 134/58 R

(58) Field of Classification Search ..... 134/113, 134/56 R; 68/12.27
See application file for complete search history.

(56) References Cited

U.S. PATENT DOCUMENTS

| | | | | |
|---|---|---|---|---|
| 3,657,073 | A | 4/1972 | Burton et al. | 195/127 |
| 3,861,875 | A | 1/1975 | Joslyn | 23/230 B |
| 3,911,256 | A | 10/1975 | Jones | 235/151.3 |
| 4,329,649 | A | 5/1982 | Scoates | 324/438 |
| 5,032,186 | A | 7/1991 | Childers et al. | 134/25.2 |
| 5,038,807 | A | 8/1991 | Bailey et al. | 134/57 D |
| 5,172,572 | A | 12/1992 | Ono | 68/12.02 |
| 5,259,219 | A | 11/1993 | Dausch et al. | 68/207 |
| 5,422,276 | A | 6/1995 | Colvin | 436/1 |
| 5,446,531 | A | 8/1995 | Boyer et al. | 356/72 |
| 5,491,092 | A | 2/1996 | Colvin | 436/1 |
| 5,498,347 | A | 3/1996 | Richard | 210/739 |
| 5,565,634 | A | 10/1996 | Graessle et al. | 73/865.9 |
| 5,603,233 | A | 2/1997 | Erickson et al. | 68/12.02 |
| 5,706,840 | A | 1/1998 | Schneider et al. | 134/56 R |
| 5,746,835 | A | 5/1998 | Turner et al. | 118/723 MW |

(Continued)

FOREIGN PATENT DOCUMENTS

EP 0 506 137 A1 3/1992

(Continued)

*Primary Examiner*—Frankie L. Stinson
(74) *Attorney, Agent, or Firm*—Gregory S. Bollis

(57) ABSTRACT

A device is provided for monitoring a wash process inside a mechanical washing apparatus, comprising sensor means for measuring physical and/or mechanical parameters of the wash process and recording means for recording the measured parameters within the device. This device comprises means for conducting a washing liquor past the sensor means and means for determining a certain contact time between the washing liquor and the sensor means.

14 Claims, 2 Drawing Sheets

U.S. PATENT DOCUMENTS

| | | | | |
|---|---|---|---|---|
| 5,788,925 | A | 8/1998 | Pai et al. | 422/3 |
| 5,906,802 | A | 5/1999 | Langford | 422/300 |
| 5,923,432 | A | 7/1999 | Kral | 356/432 |
| 5,928,948 | A | 7/1999 | Malchesky | 436/2 |
| 6,193,931 | B1 | 2/2001 | Lin et al. | 422/28 |
| 6,394,111 | B1 | 5/2002 | Jacobs et al. | 134/113 |
| 6,516,818 | B2 | 2/2003 | Jacobs et al. | 134/113 |
| 6,517,775 | B1 | 2/2003 | Wang et al. | 422/3 |
| 6,536,060 | B1 | 3/2003 | Janssens et al. | 8/159 |

FOREIGN PATENT DOCUMENTS

| | | | |
|---|---|---|---|
| EP | 0 549 467 | A1 | 12/1992 |
| JP | 360060729 | A | 4/1985 |
| JP | 407294510 | A | 11/1995 |
| WO | WO 00/25887 | | 5/2000 |

DEVICE FOR MONITORING A WASH PROCESS

CROSS-REFERENCE TO RELATED APPLICATIONS

This is a divisional of U.S. patent application Ser. No. 10/013,799, filed on Dec. 11, 2001, now U.S. Pat. No. 7,150,284, which claims priority to European Patent Application number 00204536.7, filed Dec. 15, 2000.

FIELD OF THE INVENTION

The invention relates to a device for monitoring a wash process inside a mechanical washing apparatus, comprising sensor means for measuring physical and/or mechanical parameters of the wash process and recording means for recording the measured parameters within the device.

With the expression "mechanical washing apparatus" each apparatus for washing objects is meant which functions based upon, at least, a mechanical action (however without excluding any other, such as for example chemical or biological, action). An example of such an apparatus may be a ware washing apparatus, however also apparatuses for washing other objects, such as for example laundry, are meant. Further, "physical" is to be understood as including biological and chemical too.

BACKGROUND OF THE INVENTION

The optimisation of the operation of mechanical washing apparatuses becomes more and more an important customer request. By such an optimisation not only the obtained performance of the apparatus may be optimised, but it also becomes possible to take into account other factors, such as an improved use of materials, a reduced energy consumption and a reduction of environmental pollution. It is evident that the possibility of optimising the operation of such an apparatus constitutes an increasingly important economical factor. As a first step to such an optimisation the parameters defining the wash process have to be determined.

It is an object of the present invention to provide an improved device for enabling such a determination.

DEFINITION OF THE INVENTION

Thus, according to the invention, the device is characterized by means for conducting a washing liquor past the sensor means and means for determining a certain contact time between the washing liquor and the sensor means. As a result the above-mentioned parameters can be determined in an effective way, notwithstanding the sometimes short periods the device is in contact with the washing liquor.

DETAILED DESCRIPTION OF THE INVENTION

The device according to the invention may be applied to different wash processes, industrial as well as domestic. Thus it is possible, that the wash process is a domestic laundry wash process, wherein the monitoring device is introduced into a revolving drum of a washing machine. Another possibility is, that the wash process is an industrial laundry wash process, wherein the monitoring device is introduced into a tunnel washing machine. In this latter case the device will follow the laundry through the entire tunnel, thus measuring at all different stages of the wash process.

However, the device according to the invention is not only applicable to a laundry wash process, but also to a ware wash process. Thus, the wash process might be a domestic ware wash process, wherein the monitoring device is introduced into a ware washer, but also the wash process might be an industrial ware wash process, wherein the monitoring device is introduced onto, and moves along with a conveyor belt of an industrial ware washer. In this aspect, the expression "ware" is to be understood as comprising, among others, dishes, bottles (glass as well as plastic), pots, pans etcetera.

According to a preferred embodiment of the device the sensor means are located in a central cavity of the device, wherein an entry channel connects the surroundings with the central cavity.

In the central cavity the sensor means are protected against damage, whereas nevertheless the entry channel exposes the sensor means to the washing liquor. The central cavity further contributes to a sufficient contact time.

Further it is possible that the entry channel is provided with an entry funnel. Such a funnel promotes the entry of washing liquor into the device.

Also further, an embodiment is proposed in which the entry channel is covered by a filter. Such a filter may physically block solids from the washing liquor to avoid soiling of the sensor means.

When the central cavity further connects with the surroundings by means of an exit channel a continuous refreshment of the washing liquor in contact with the sensor means is guaranteed.

The means for determining a certain contact time between the washing liquor and the sensor means can be optimised in different ways. As a first possibility the cross-section of the exit channel is smaller than the cross-section of the entry channel. However it is also possible, that in the exit channel obstruction means are provided.

Still another possibility is, that the entry channel and exit channel are interconnected by a meandering channel section, wherein the central cavity adjoins the meandering section.

In a preferred embodiment of the device according to the invention the entry channel extends substantially centrally of the device, whereas the exit channel comprises a circumferential slot extending radially outward from the central cavity. The washing liquor enters the device centrally (axially) through the entry channel and reaches the central cavity with sensor means. From there the washing liquor flows radially out of the device.

When, in this embodiment, the central cavity is surrounded by a ledge partially separating the central cavity from the exit channel, the above-mentioned contact time still can be enlarged. This contact time is also determined by the width of the slot.

In a very special embodiment the entry channel is shaped similar to a bottle. Thus the washing process within a bottle-washer may be reproduced and monitored. In its most simple form a bottle without its bottom is positioned on top of a basis supporting the sensor means. Exit means for the washing liquor should be provided preventing the bottle from overfilling.

When the device comprises attachment means for attaching it to the mechanical washing apparatus, it can follow predetermined tracks through the apparatus.

Another embodiment of the device is mentioned, wherein it is part of a diagnosis rack with substantially planar shape. Such a diagnosis rack is especially useful in an industrial dishwasher. If, for example, the diagnosis rack further comprises an array of sensor means, a two dimensional monitoring can be accomplished, such as of the temperature and mechanical action which both vary with the widthwise position within the apparatus (as an example the position and functioning of sprinklers for the washing liquor may be monitored effectively in this manner).

To obtain additional information about the washing process, the diagnosis rack further may comprise standard soiled substrates, such as plates or alike, enabling benchmarking the performance of the apparatus against other apparatuses. The degree of cleaning will provide a performance rating and from the pattern of remaining soil, additional information may be obtained.

Apart from the means mentioned before, the device may comprise other means enhancing its operation. Without being complete there may be mentioned means for the measurement of time (timer or clock), means for powering the device, and means for reading out the measured parameters by proximity to a docking station. The mechanical parameters may include, among others, force and acceleration (for example for the impact of a jet of washing liquor and the movements of the device, respectively). The physical parameters may include, among others, concentration, conductivity, pH, turbidity, redox, pCa, pNa and EC. The use of dynamic surface tension sensors is contemplated too.

The invention will be elucidated referring to the drawings in which embodiments of a device according to the invention are shown.

Figure 1:
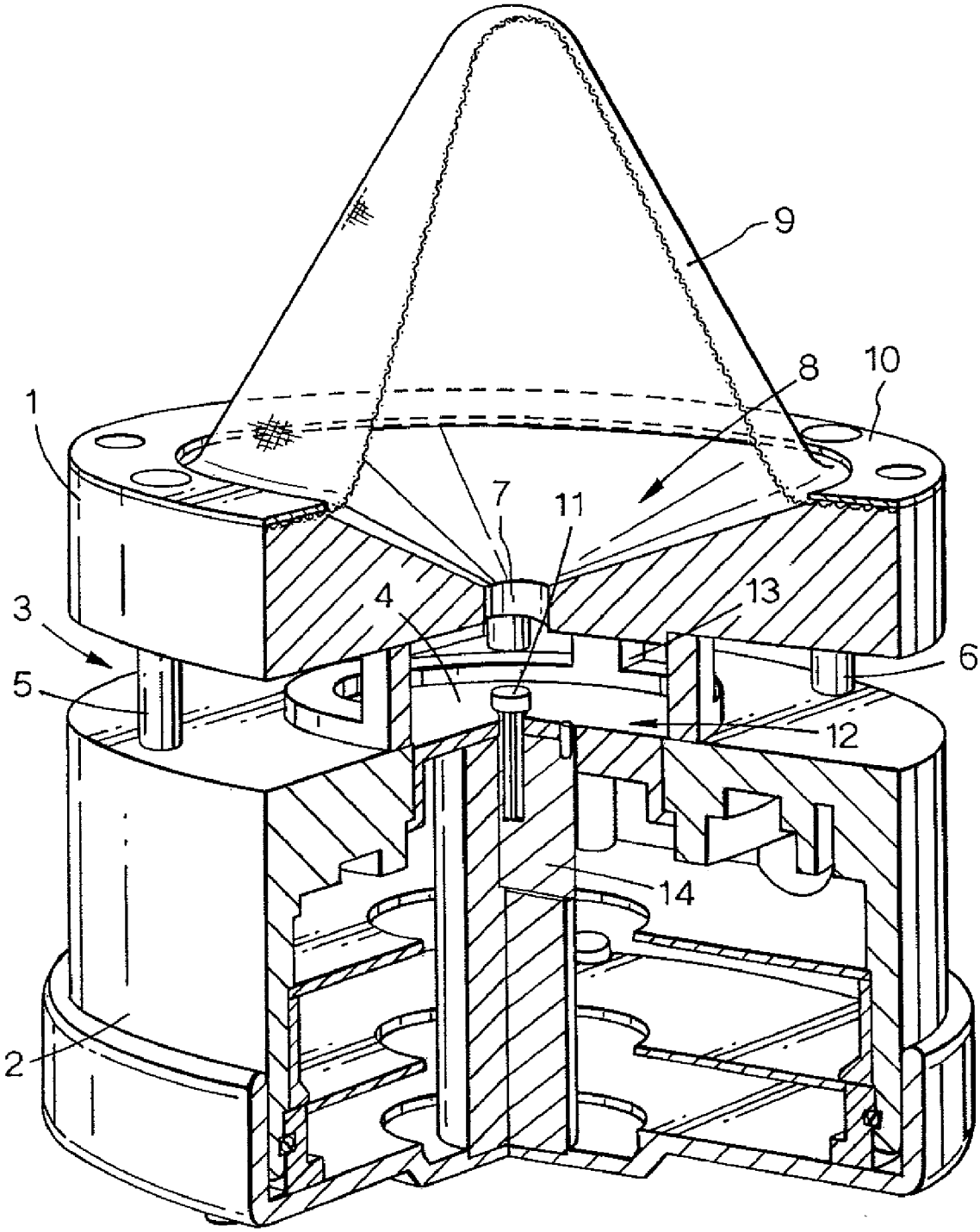
FIG. 1 shows, partly broken-away a perspective view of a first embodiment of the device according to the invention.

The device for monitoring a wash process inside a mechanical washing apparatus as shown in FIG. 1 comprises an upper housing part 1 and a lower housing part 2 separated by a circumferential slot 3 extending radially outward from a central cavity 4. The upper housing part 1 and lower housing part 2 are interconnected and kept at a certain distance by means of distance pins 5. Further a ground pin 6 is shown.

The central cavity 4 connects to the surroundings by an entry channel 7 provided with an entry funnel 8. Furthermore a filter 9, which is attached to the upper housing part 1 with a filter ring 10, covers the entry funnel 8 of the entry channel 7.

Within the central cavity 4 sensor means for measuring, among others, physical and/or mechanical parameters of the wash process are positioned. Of these sensor means FIG. 1 shows clearly a protruding temperature sensor 11. This temperature sensor 11, but also the other sensor means not illustrated, are positioned such in a sensor cartridge 12 that washing liquor entering the central cavity 4 through the entry funnel 8 and entry channel 7 will contact these sensor means. Thereafter the washing liquor will leave the device through the slot 3.

The central cavity 4 is surrounded by a ledge 13 partially separating the central cavity 4 from the slot 3 which functions as an exit channel. The dimensions of the ledge 13 as well as the dimensions of the slot 3 determine the flow rate of the washing liquor through the slot 3, and thus the contact time between the washing liquor and the sensor means. Among others, by amending the length of the distance pins 5 this flow rate may be amended. Thus, a sufficient contact time between the sensor means and entering washing liquor may be guaranteed, also in cases where the device resides only a short time in the washing liquor.

The interior 14 of the lower housing part 2 is hollow and houses several components of the device, such as recording means for recording the measured parameters, energy means for powering the device, means for measuring of the elapsed time, such as a timer or clock, and means for reading out the information stored in the recording means by proximity to a docking station etcetera. For example, parameters measured by the sensors means will be exchanged with an external device (not shown) by exchanging means, for example an inductive link. This inductive link also may be used for automatically recharging energy means such as batteries of the device when the monitoring device interacts with the external device. In such a case the batteries are rechargeable.

Figure 2:
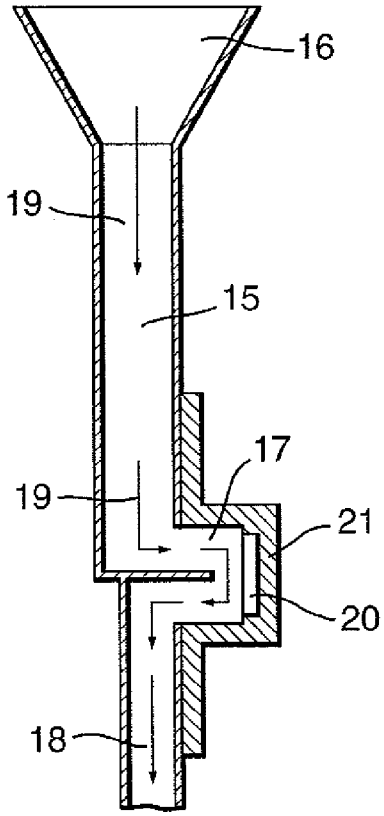
FIG. 2 shows, schematically, a second embodiment of the device according to the invention.

In FIG. 2 schematically a second embodiment of a monitoring device according to the invention is illustrated. An entry channel 15 with entry funnel 16 is connected to an exit channel 18 by means of a meandering channel section 17. The flow of a washing liquor is indicated by arrow 19.

The central part of the meandering channel section 17 is in contact with sensor means 20 which are surrounded by a housing 21 which may correspond with the lower housing part 2 of the embodiment according to FIG. 1.

The meandering channel section 17 creates a flow restriction, thus enabling a certain contact time between a washing liquor and the sensor means 20. Further, as visible in FIG. 2, the cross-section of the exit channel 18 is smaller than the cross-section of the entry channel 15. This also is helpful in providing a certain contact time. Another way of realising the desired contact time could be the provision of obstruction means in the exit channel 18 (not shown).

The device according to FIG. 2 is particularly useful for monitoring a wash process inside a mechanical ware washing apparatus or dishwasher.

Figure 3:
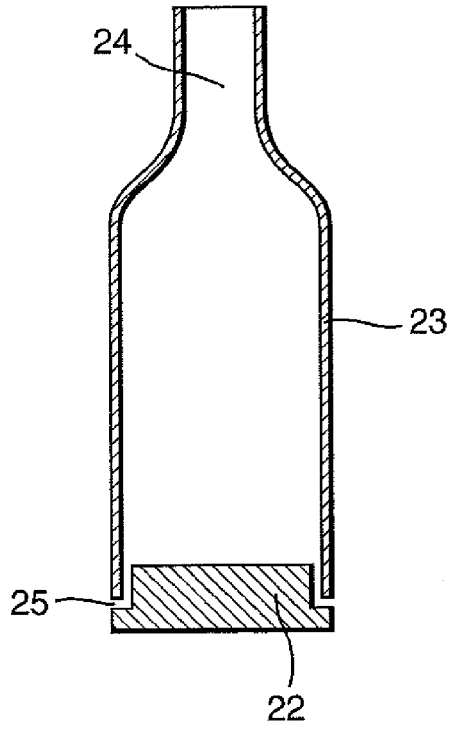
FIG. 3 shows, schematically, a third embodiment of the device according to the invention.

FIG. 3 shows, extremely simplified, the basic characteristic of still another embodiment of the monitoring device according to the invention. A base 22 is provided which might correspond with the lower housing part 2 according to FIG. 1, and which is provided with sensor means (not shown). On top of said base a bottle-like part 23 is positioned defining an entry channel 24. An exit channel 25 is defined between the lower part of the bottle-like part 23 and the base 22.

This embodiment of the device for monitoring a wash process is meant for use in a bottle-washer. The bottle-like part 23 simulates the conditions inside a bottle to be washed. By the way, the bottle-like part 23 indeed may be a bottle, of which the bottom has been removed.

Figure 4:
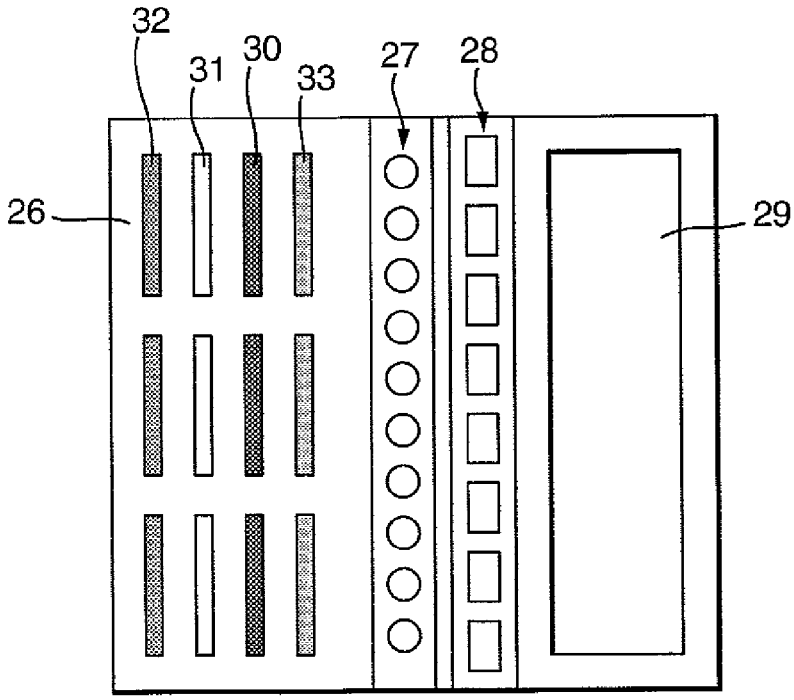
FIG. 4 shows, again schematically, a top plan view of a fourth embodiment of the device according to the invention.

Finally, reference is made to FIG. 4 in which a diagnosis rack 26 is shown in a top plan view. This diagnosis rack 26 is meant to be put on a conveyor belt of a mechanical ware washing apparatus and to travel along therewith through the apparatus, in the same way as the ware to be washed. Two parallel arrays 27 and 28 of sensors (for example, temperature sensors and pressure sensors) extend in parallel along the diagnosis rack 26. A space 29 is provided for other sensors, for energy means, for recording means or for a monitoring device, for example as illustrated in one of the previous figures. The rack (26) also contains means (not shown) for attaching a device according to the present invention as shown in FIG. 1 thereto.

The importance of such a diagnosis rack may be illustrated as follows. While travelling through a washing apparatus, the parameters to be measured vary. However, these parameters may also vary over the width of the conveyor belt, since for example sprinklers for the washing liquor may not be placed optimally, or due to wall effects. Therefore, a two-dimensional scan of, for example, the temperature and the mechanical action is performed by the arrays 27, 28 of sensors. This provides a good way to visualise the wash process inside of the apparatus. More particularly, this scan gives information on the value of the measured parameters over the width of the apparatus as a function of time (during the period wherein the rack travels through the apparatus).

Because the temperature, and especially the mechanical action, on the surface of the ware to be washed may be different from the values measured by the sensor arrays 27, 28, it is proposed to equip additional plates 30 with temperature and force sensors. Furthermore, the cleaning performance of a specific mechanical ware washing apparatus can be benchmarked against other apparatuses by putting standard soiled plates 31 on the diagnosis rack 26. The degree of cleaning of these standard soiled plates 31 will provide a performance rating and from the pattern of the remaining soil additional information may be obtained.

Finally, FIG. 4 shows shield plates 32 and customer soiled plates 33.

The invention is not limited to the embodiments described before which may be varied widely within the scope of the invention.

The invention claimed is:

1. A device for monitoring a wash process inside a mechanical ware washing apparatus, the device comprising:

a housing that can be received within a washing chamber of the ware washing apparatus during a wash cycle, the housing configured to conduct washing fluid through a flow path having a shape that is similar to a bottle, the flow path having an entry positioned at a mouth of the bottle shape, an exit positioned at a base of the bottle shape, the exit having a cross-section that is smaller than the cross-section of the entry to control the flow rate of washing fluid through the flow path;

a sensor coupled to the housing and positioned within the flow path to measure physical and/or mechanical parameters within a bottle being washed by the ware wash apparatus; and a recording device coupled to the housing and in communication with the sensor to record measured parameters.

2. A device according to claim 1, wherein the sensor is located in a central cavity of the device and wherein an entry connects the surroundings with the central cavity.

3. A device according to claim 2, wherein the entry extends substantially centrally of the device, whereas the exit comprises a circumferential slot extending radially outward from the central cavity.

4. A device according to claim 1, wherein the entry is provided with an entry funnel.

5. A device according to claim 1, wherein the entry is covered by a filter.

6. A device according to claim 1, wherein an obstruction means is provided at the exit.

7. A device according to claim 1, further comprising an attachment means for attaching the device to the mechanical washing apparatus.

8. A device for monitoring a wash process inside a mechanical laundry washing apparatus, the device comprising:

a housing that can be received within a washing chamber of the laundry washing apparatus during a wash cycle, the housing configured to conduct washing fluid through a flow path having an entry, an exit, and a meandering flow path between the entry and the exit, the exit having a cross-section that is smaller than the cross-section of the entry to control the flow rate of washing fluid through the flow path;

a sensor coupled to the housing and positioned within the flow path to measure physical and/or mechanical parameters within the laundry wash apparatus; and a recording device coupled to the housing and in communication with the sensor to record measured parameters.

9. A device according to claim 8, wherein the sensor is located in a central cavity of the device and wherein an entry connects the surroundings with the central cavity.

10. A device according to claim 9, wherein the entry extends substantially centrally of the device, whereas the exit comprises a circumferential slot extending radially outward from the central cavity.

11. A device according to claim 10, wherein the central cavity is surrounded by a ledge partially separating the central cavity from the exit channel.

12. A device according to claim 8, wherein the entry is provided with an entry funnel.

13. A device according to claim 8, wherein the entry is covered by a filter.

14. A device according to claim 8, wherein an obstruction means is provided at the exit.

* * * * *